US006935244B2

(12) United States Patent
Lechner et al.

(10) Patent No.: US 6,935,244 B2
(45) Date of Patent: Aug. 30, 2005

(54) TRANSPORT SYSTEM

(76) Inventors: Alexander Lechner, Dietrichsteinerstr. 27, Faak Am See (AT), A-9583; Andreas Wotke, Haseldorfergasse 18, Klosterneuburg (AT), A-3400

( * ) Notice: Subject to any disclaimer, the term of this patent is extended or adjusted under 35 U.S.C. 154(b) by 0 days.

(21) Appl. No.: 10/332,817

(22) PCT Filed: Jul. 10, 2001

(86) PCT No.: PCT/AT01/00228

§ 371 (c)(1),
(2), (4) Date: Jan. 13, 2003

(87) PCT Pub. No.: WO02/04273

PCT Pub. Date: Jan. 17, 2002

(65) Prior Publication Data

US 2004/0089188 A1 May 13, 2004

(30) Foreign Application Priority Data

Jul. 11, 2000 (AT) ..... A 1191/2000
Apr. 17, 2001 (AT) ..... A 617/2001

(51) Int. Cl.[7] ..... E01B 25/00
(52) U.S. Cl. ..... 104/130.07; 104/96; 104/124
(58) Field of Search ..... 104/96, 104, 105, 104/118, 93, 89, 130.07, 124, 125; 105/141, 148, 150

(56) References Cited

U.S. PATENT DOCUMENTS

| | | | | | |
|---|---|---|---|---|---|
| 305,060 | A | * | 9/1884 | Downing | 186/3 |
| 310,393 | A | * | 1/1885 | Downing | 186/3 |
| 429,847 | A | * | 6/1890 | Dickey et al. | 105/150 |
| 583,704 | A | * | 6/1897 | Henkel et al. | 104/105 |
| 994,461 | A | * | 6/1911 | Harding | 104/96 |
| 2,997,003 | A | | 8/1961 | Thompson | |
| 3,628,462 | A | | 12/1971 | Holt | |
| 4,276,831 | A | * | 7/1981 | Leger | 104/93 |
| 4,862,807 | A | | 9/1989 | Guadagno | |

FOREIGN PATENT DOCUMENTS

| | | | |
|---|---|---|---|
| DE | 1940 256 | | 2/1971 |
| DE | 29 08 369 | | 9/1980 |
| DE | 36 05 317 | C1 | 2/1987 |
| DE | 42 01 468 | A1 | 7/1992 |
| DE | 195 46 694 | A1 | 6/1997 |
| DE | 198 06 990 | A1 | 9/1999 |
| EP | 0 164 109 | A1 | 12/1985 |
| EP | 0 829 578 | A2 | 3/1998 |
| EP | 0 831 000 | A1 | 3/1998 |
| GB | 2 333 747 | A | 8/1999 |
| JP | A 54-57715 | | 5/1979 |
| JP | 54-146314 | * | 11/1979 |
| WO | 98/24673 | | 6/1998 |

* cited by examiner

*Primary Examiner*—Mark T. Le
(74) *Attorney, Agent, or Firm*—Young & Thompson

(57) ABSTRACT

A transport system has at least one track, preferably hung on supports or hanging from cables, on which transport cars may travel, by at east one trolley. Several running wheels are provided in the trolley and the trolley may be actively rotated about the axis of the track relative to the transport car. Branchings are provided in the track, in which the track divides into two track branches. In the vicinity of the branching lies an intersection of the outer surfaces of the track branches, such that on each of the upper side and the lower side there are two grooves due to the intersection, which meet in the vicinity of the gusset, between the two track branches. Between the grooves, on both the upper and lower side, is a tapering web, the surfaces of which are part of the surface area of the track branches.

24 Claims, 13 Drawing Sheets

TRANSPORT SYSTEM

BACKGROUND OF THE INVENTION

The invention relates to a transportation system with at least one rail and with at least one car which can be moved along the rail via at least one trolley.

DESCRIPTION OF THE RELATED ART

Transportation systems, especially monorail transportation systems for people or freight, are known in various embodiments. These transportation systems are used among others in amusement parks and as material transportation systems in factories.

Systems are known in which cars can be moved suspended along a rail (DE 42 01 468 A). Systems are also known in which cars ride on the rail (GB 23 33 747 A).

Monorail transportation systems with rails suspended in a self-supporting manner allow transportation systems independent of road traffic in conurbations (DE 195 46 694 A). Monorail transportation systems are also especially suited for fully automatic, in any case computer-controlled operation (EP 941 189 A). Monorail trains can be operated with different drive concepts, such as linear motors, maglev technology (EP 831 000 A).

In spite of the favorable properties, monorail transportation systems have hardly prevailed over conventional transit systems. One reason is that to date a simple and reliable approach to implementation of junctions of the rails has not been proposed. The known junctions require complex, mechanical constructions with moving parts (EP 829 578 A, DE 198 06 990 A and DE 29 08 369 A). Known proposals for junctions without mechanical parts (JP 54 05 7715 A) can only be used to a limited degree.

A transportation system of the initially mentioned type is known from DE 36 05 317 C. In this transportation system two rollers supported in an open bracket roll on the rails which are bent roof-like to the top. In the area of one junction of the rails there is a switching means with forced guidance which can be adjusted by a cylinder, following the changing device instead of the bent rail there being grooved rails with bearing surfaces which run essentially horizontally.

In the transportation system as claimed in DE 36 05 317 C the bows with the two rollers can be turned around an axis which runs essentially parallel to the lengthwise extension of the rails. When a bow moves in the area of the changing means, the bows are turned by engaging the restricted guidance on the rollers—therefore passively, and move following the changing means onto one or the other rail branch emerging from the junction.

The construction of the transportation system as claimed in DE 36 05 317 C presupposes that in the area of each junction of the rail path there are the restricted guidance and an actuating element for it. If there is no one to actuate the restricted guidance at each changing means of the known transportation system, it is necessary to link the changing means to a central control for adjusting the restricted guidance according to the desired direction of travel.

The conveyor system which is described in DE 19 40 256 B for the clothing industry has two rollers which are connected to one another by a bow and which run along rails which are bent roof-like to the top. DE 19 40 256 B does not describe any junctions of the rails. The turning of the bows with the rollers mentioned in DE 19 40 256 is used solely to turn the bows into a position in which they can be removed from the rail.

SUMMARY OF THE INVENTION

The object of the invention is to propose a transportation system of the initially mentioned type in which junctions are made without moving parts.

In the transportation system as claimed in the invention, on preferably cylindrical rails which are made as straight or curved bars or pipes and which can be suspended in a self-supporting manner, cars equipped preferably with a traction drive can be moved via trolleys. In the transportation system as claimed in the invention, the junctions are formed by the rail being divided in the area of the junctions into two rail branches, in the area of the junction the preferably round cross sectional shape of the two rail branches which run away from one another in the area of the junction being essentially preserved. This is achieved in the invention in that in the rails in the area of the junctions there are grooves which run in the direction of the lengthwise extension of the rail and the two rail branches. These grooves which are provided generally on the top and on the bottom of the rails and rail branches meet essentially in the gusset of the rail branches proceeding from the junction. Preferably on both the top and also the bottom of the rail and the rail branches there are two grooves each. These grooves, which follow essentially the axes of the rail branches which lead away from the junction, between themselves on the top and the bottom of the rail which leads to the junction, yield a tapering rib with inner side surfaces which are parts of the outside contour of the rail branches which lead away from the junction.

With the execution of the junction as claimed in the invention, symmetrical junctions and asymmetrical junctions (right and left switches) can be formed.

Cars used within the framework of the invention have at least one trolley which extends only partially around the rail and is guided on it for example via at least three rollers. These three rollers are preferably located at an angular distance of roughly 120° from one another, its being further preferred that the two outer rollers are located in the area of the edge of the slot of the trolley.

Furthermore, in the transportation system as claimed in the invention the trolley can therefore be actively turned around one axis relative to the car by a drive assigned to the trolley or by tilting the rollers, via which the trolley is guided on the rail, and not passively as in DE 36 05 317 C by the restricted guidance; this axis essentially coincides with the axis of the rail. This moreover makes it possible in normal travel to align the slot of the trolley for example pointing upward when the rail is suspended via means which point perpendicularly to the top. The trolley can also be turned when the means which bear the rail are aligned obliquely, for example pointing laterally upward, such that the means bearing the rail are located in the area of the slot of the trolley.

By actively turning the trolley it is possible, in junctions which are made as described above, to determine which rail branch proceeding from the junction the car follows. This is always the rail branch of the forking rail, along the side of which facing away from the other rail branch the middle roller of the trolley is guided. The other two rollers of the trolley move along the flanks of the grooves (=surfaces of the tapering rib) which correspond to one part of the outside surface of the rail branch along which the middle roller of the trolley rolls.

Thus, with the invention a transportation system is devised in which by actively turning the trolley it can be determined on which rail branch proceeding from the junction the car moves when it is travelling over a junction, without there also being only one moving part in the area of the junction. It is enough to turn the trolley such that it moves and thus the car moves on the respectively chosen rail branch of the junction.

Since in the transportation system as claimed in the invention, differently than in DE 36 05 317 C, in the area of the junctions or forks of the rails movable elements are no longer necessary, in the invention any expenditure for control of these moving elements is eliminated. Rather in the invention it is such that the car itself "seeks the path" by the trolley being turned even before the trolley enters a junction.

The invention is especially suited for monorail transportation systems with suspended cars, but embodiments with two rails located next to or on top of one another, between which the cars move, and systems in which the cars travel above the rail (or rails), are possible.

The trolley can be guided on the rail in any desired manner. The guide means can be rollers, sliders, or the like. But it is also possible to guide the trolley on the rail via air bearings and or by magnetic forces.

The invention furthermore relates to rollers with which trolleys of transportation systems on rails can be guided. These rollers are used preferably for the transportation system.

BRIEF DESCRIPTION OF THE DRAWINGS

Other details, advantages and features of the invention result from the following description of preferred embodiments using the drawings.

DESCRIPTION OF THE PREFERRED EMBODIMENTS

Figure 1:
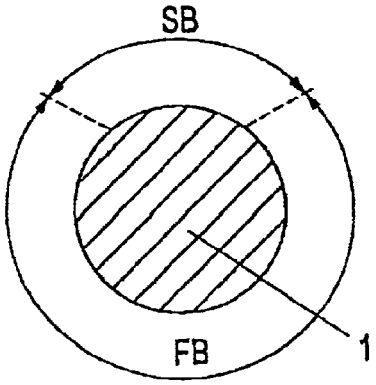
FIG. 1 shows in cross section a rail for explanation of the concepts "travelling area" and "blocking area"

FIG. 1 shows in a section a cylindrical rail 1, in FIG. 1 the travelling area being labelled "FB" on the one hand and the blocking area being labelled "SB" on the other. The travelling area FB encompasses the carrier rail 1 by more than 180° and is chosen to be at least large enough to allow the rail 1 to be easily traversed by a trolley 2 of a car. The blocking area SB is the area in which suspensions can be attached to the rail 1.

Figure 2:
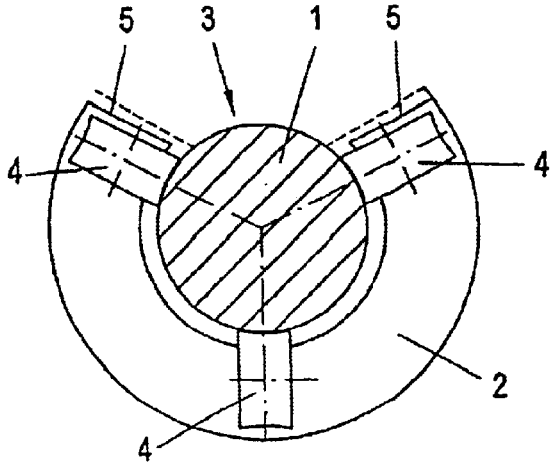
FIG. 2 shows in cross section a rail with trolley guided on it (schematic)

FIG. 2 shows that one trolley 2 on which a car which is not shown in FIG. 2 is suspended has a slot 3 so that the trolley 2 does not extend into the blocking area SB. In the trolley 2 at least three rollers 4 are pivotally supported, of which at least one roller 4 can be driven if at least one of the rollers 4 is also used for driving the car for moving it along the rail 1. It is shown that the rollers 4 are arranged in the trolley 2 such that relative to the axis of the rail 1 they have an angular distance from one another of roughly 120°, the two outside rollers 4 in the area of the edges 5 of the slot 3 being located in the trolley 2, therefore marginally outside of the blocking area SB.

Figure 3:
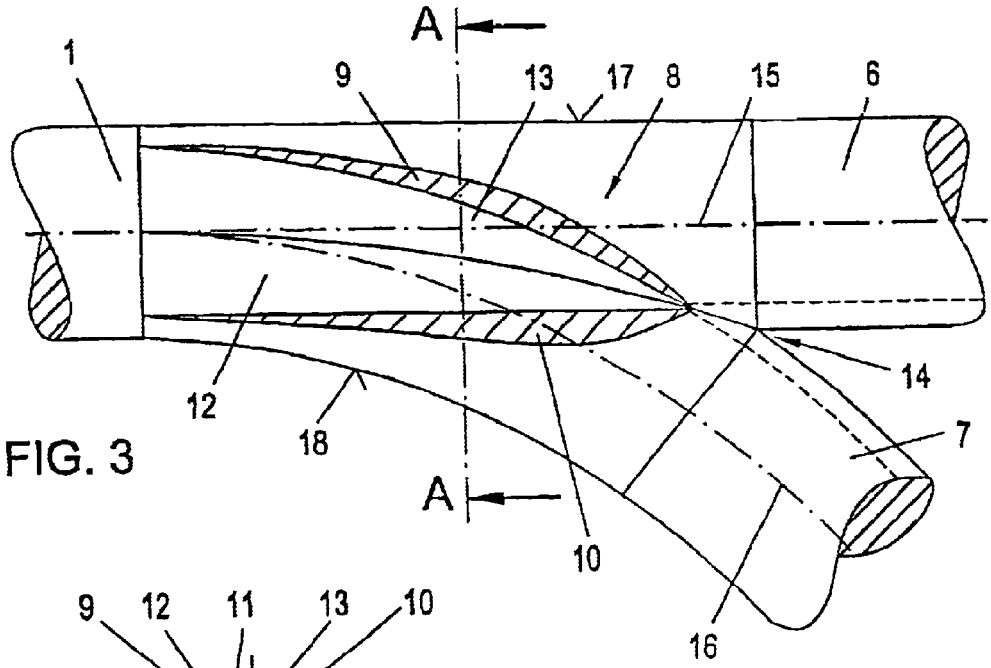
FIG. 3 shows one embodiment of a junction.
Figure 3A:
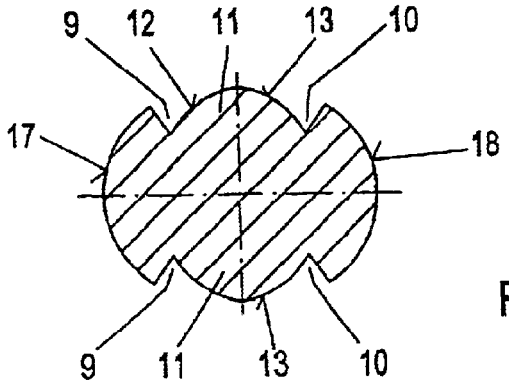
FIG. 3*a* shows a section along the line A—A in FIG. 3.

A junction 8 of the rail 1 from which two rail branches 6 and 7 proceed, which junction is provided in the transportation system as claimed in the invention, is shown in the first embodiment in FIGS. 3 and 3*a*. It is apparent that on the junctions 8 from which the two rail branches 6 and 7 proceed there are grooves 9 and 10 on the top and bottom so that in the area of the junction 8 the outside contour of the rail branches 6 and 7, which contour is round in this embodiment, is essentially preserved especially in the travelling area FB. The groove 9 and 10, which in the example of FIGS. 3 and 3*a* have an essentially V-shaped cross sectional shape, each yield on the top and bottom of the junction 8 a tapering rib 11, the surfaces 12 of the ribs 11 forming part of the outside surface of the rail branch 6, which surface is interrupted by the grooves 9 in the area of the junction 8, and the other surfaces 13 of the ribs 11 form part of the outside surface of the rail branch 7, which surface is interrupted by the grooves 10 in the area of the junction 8. The grooves 9 and 10 which meet in the area of the gusset 14 between the rail branches 6 and 7 (the ribs 11 also end there) run parallel or concentrically to the axes 15 and 16 of the rail branches 6 and 7. Since the rail branch 6 is straight, the grooves 10 are also straight, conversely the grooves 9 run curved according the curved rail branch 7.

Figure 4C:
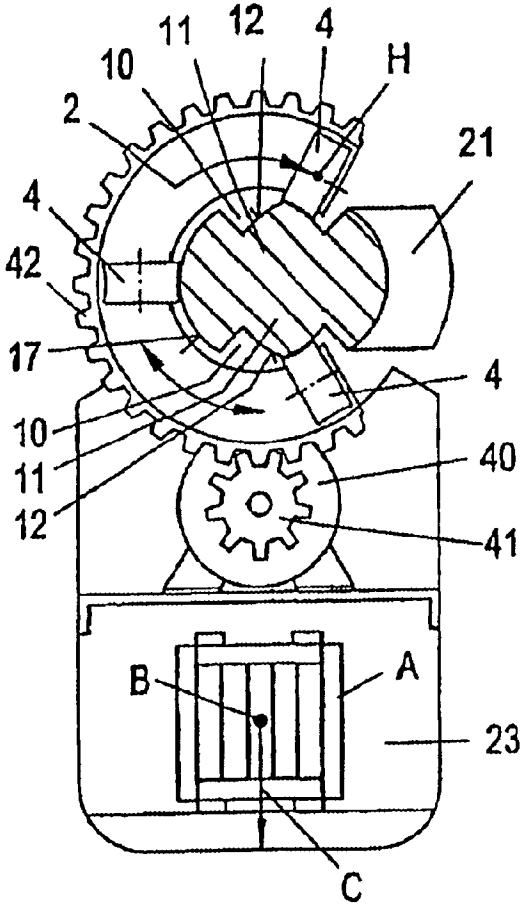
FIG. 4*c* shows the position of the trolley when travelling over a junction.
Figure 4B:
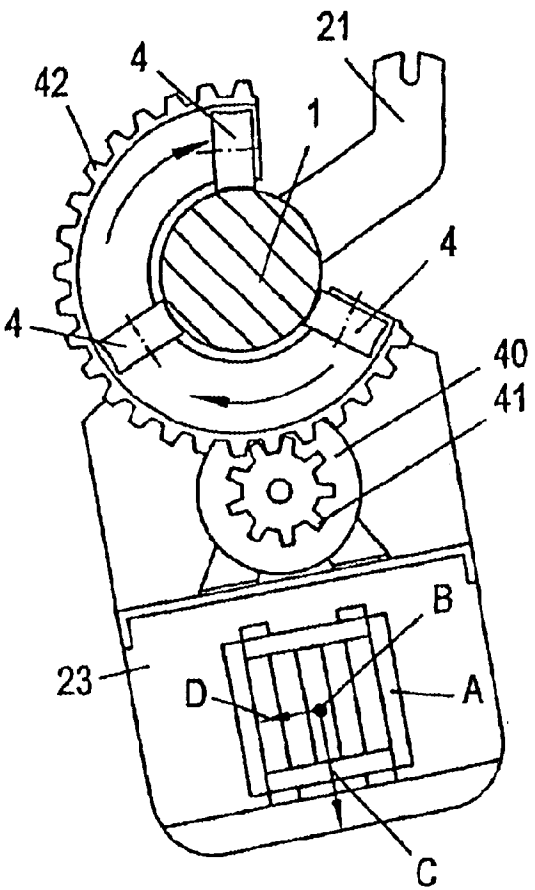
FIG. 4*b* shows a rail with oblique suspension and with cars.
Figure 4A:
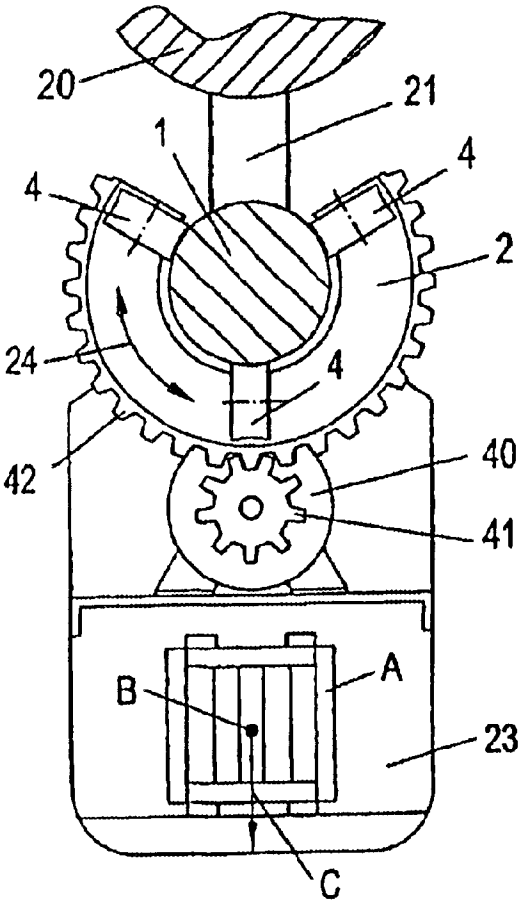
FIG. 4*a* shows a vertically suspended rail with cars and a drive for turning the trolley (schematic)

In FIG. 4*a* a rail 1 is suspended in a self-supporting manner on a support part 20 which is shown only schematically via suspensions 21. The trolley 2 with its rollers 4 is connected by connecting elements 22 (FIG. 5) to a car 23. The connecting elements 22 between the cars 23 and trolley 2 are made such that the trolley 2 car by turned around the axis of the rail 1 as is illustrated by the double arrow 24 in FIG 4*a*. The trolley is turned for example by an actuator 40 via a transmission, formed by a pinion 41 and a gear rim 42 which is connected to the trolley 2, without being limited to this embodiment.

FIG. 4*a* shows the position of trolley 2 when a rail 1 is being traversed, if the suspensions 21 project to the top perpendicularly from the rail 1.

FIG. 4*b* shows in an analogous manner the car 23 with the trolley 2, the trolley 2 assuming a rotary position which makes it possible for the rail 1 to be supported by suspensions 21 which run obliquely to the top. Turning of the trolley 2 is effected by the fact that during the driving motion of the trolley 2 the car 23 is deflected laterally via the actuator 40 and the overall center B of gravity formed by the center of gravity of the car 23 and its load A to its vertical weight component C develops a transverse force D which forces the trolley 2 into rotary motion until the position (FIG. 4*c*) is reached in which one roller 4 assumes the position labelled H in FIG. 4*c*, and the car 23 again assumes the vertical position.

FIG. 4*c* shows the situation when crossing a junction 8 (switch). The theoretical position H has been reached. The actuator 40 and the car 23 are torque-neutral.

It is apparent that the trolley 2 has been turned so far that the middle roller 4 of the three rollers 4 which are pivotally supported in the trolley 2 from the side adjoins the surface 17 of the (straight) rail branch 6 which is opposite the curved rail branch 7. In this way the two other rollers 4 of the trolley 2 are guided along the surfaces 12 of the tapering rib 11 in grooves 10 and the car 23 moves further on the rail branch 6 (which runs straight).

If conversely the trolley 2 were to be turned such that the middle roller 4 of the three rollers 4 in the trolley 2 adjoins the surface 18 of the curved rail branch 7 (FIG. 3), which surface is the inside of the curvature, and moves along this surface 18, the two other rollers 4 roll along the surfaces 13 of the ribs 11 and the car 23 would travel on the curved rail branch 7.

Figure 9:
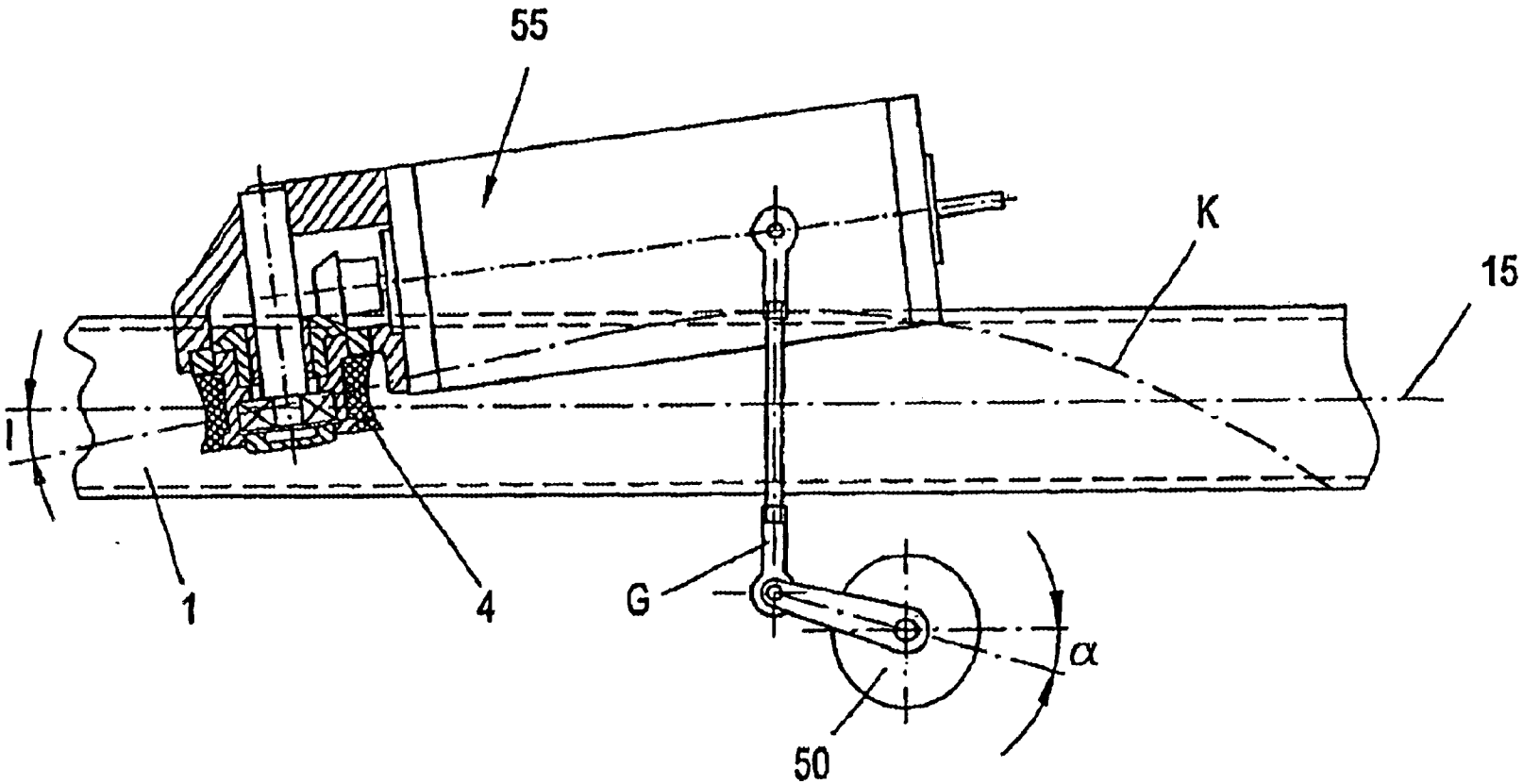
FIG. 9 shows the tilting of the rollers by an actuator.

FIG. 9 shows the adjustment possibility of the rollers 4 via their own actuator 50. By inclining of rollers 4 by the setting angle I relative to the axis 15 of the rail 1 the rollers 4 move along the helical lines K so that the trolley 2 executes a rotary motion with motion along the rail 1.

By corresponding actuation of the actuator 50 the trolley 2 can move in a controlled manner and actively into the desired rotary positions so that, suspensions avoided, a junction 8 can be traversed with the left rail branch 6 or with the right rail branch 7.

FIG. 9 shows for example a drive 55 for the roller 4.

In the transportation system it is advantageous for the trolley 2 which is provided with a slot 3 to be able to determine itself its rotary position on the rail 1 which is round in cross section by the drive 40 or the actuator 50 in order to select the travelling direction on the junctions 8 of the rail 1 or in order to avoid the suspensions 21. The trolley 2 can be provided with an electronic control which is coupled to sensors and which allows it to assume the desired rotary position at any position of the rail 1.

Figure 10:
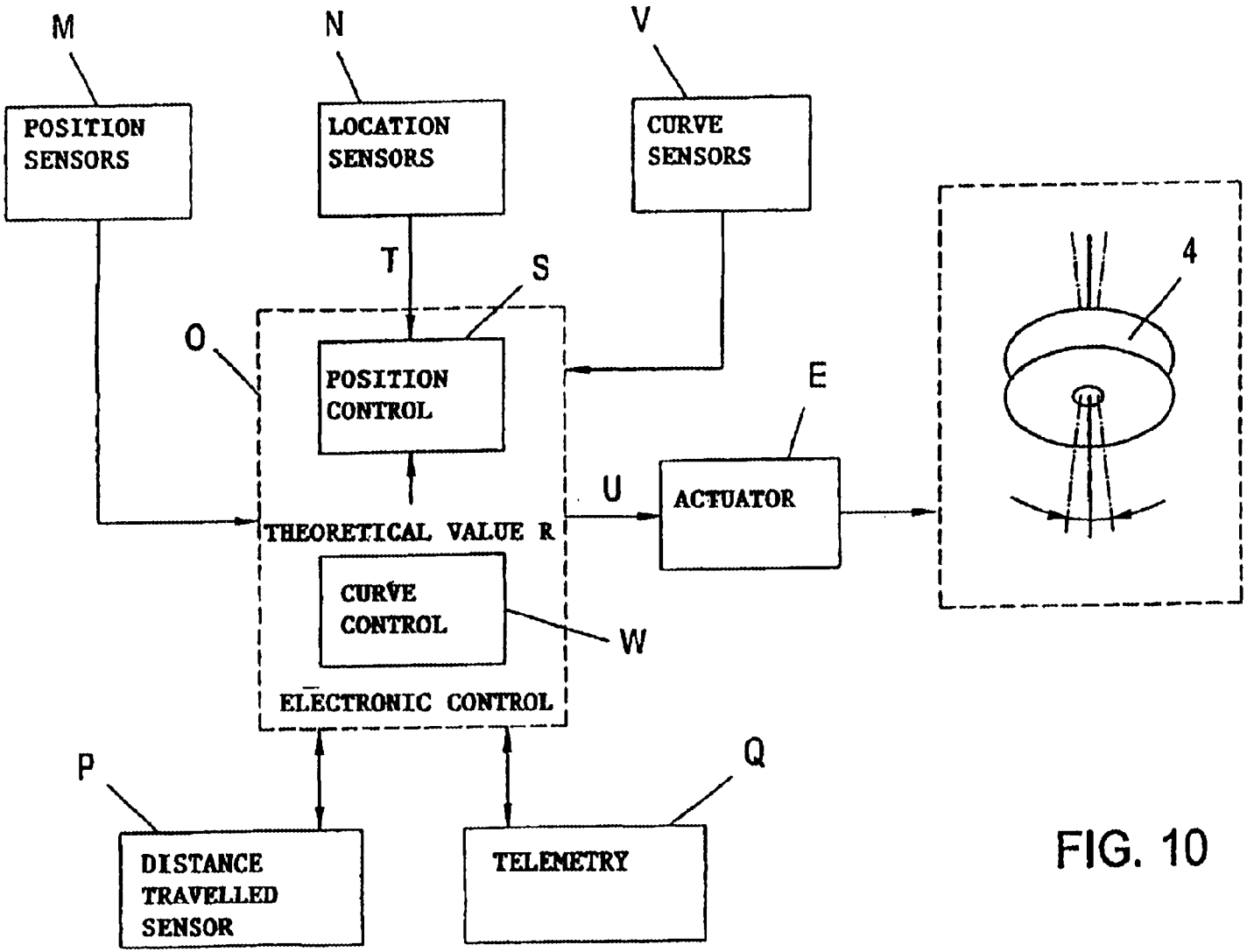
FIG. 10 schematically shows one embodiment for controlling a transportation system as claimed in the invention.

FIG. 10 shows one sample configuration of the control circuit of a car 23. The trolley 2 or the car 23 is provided both with position sensors M and also with rotary position sensors N and with an (electronic) control means O. Furthermore the electronic control unit has information about the composition of the section (rail 1) either in a storage P of the distance travelled or it is supplied with this information while travelling, for example via a telemetry system Q in order to determine the setpoint R of the rotary position of the trolley 2 which is desired at the time. The rotary position control S compares the actual value of the rotary position T which is continuously acquired by the rotary position sensor N and for deviations from the setpoint produces a control signal U for the actuator E (for example, the drive 40 or the actuator 50).

In particular, the possibility of tilting the rollers 4, for example by an actuator 50, allows very precise guidance and rotary position control of the trolley 2 on the rail 1. This makes it possible to guide the rollers 4 by the curve sensors V and the curve control W both when crossing the junctions 8 of the rail 1 and also when travelling on curves (FIG. 11) by adjusting the setting angle I exactly to the curved tracks which are defined by the toroidal execution of the rail 1.

The rollers 4 can therefore be inclined not only for turning the trolley 2 into the desired rotary position, for example, the set position H of the roller 4 (FIG. 4*c*), but also when running on curves in order to keep friction losses low, for example. This is advantageous especially in one embodiment of a trolley 2 in which there are in succession two groups of three rollers 4 at a time.

The control electronics can be made such that it adjusts the setting angle I of the rollers 4 such that at the same time both the desired rotary motions of the trolley 2 are executed and also matching of the position of the rollers 4 to the curves of the rail 1 takes place.

Figure 11:
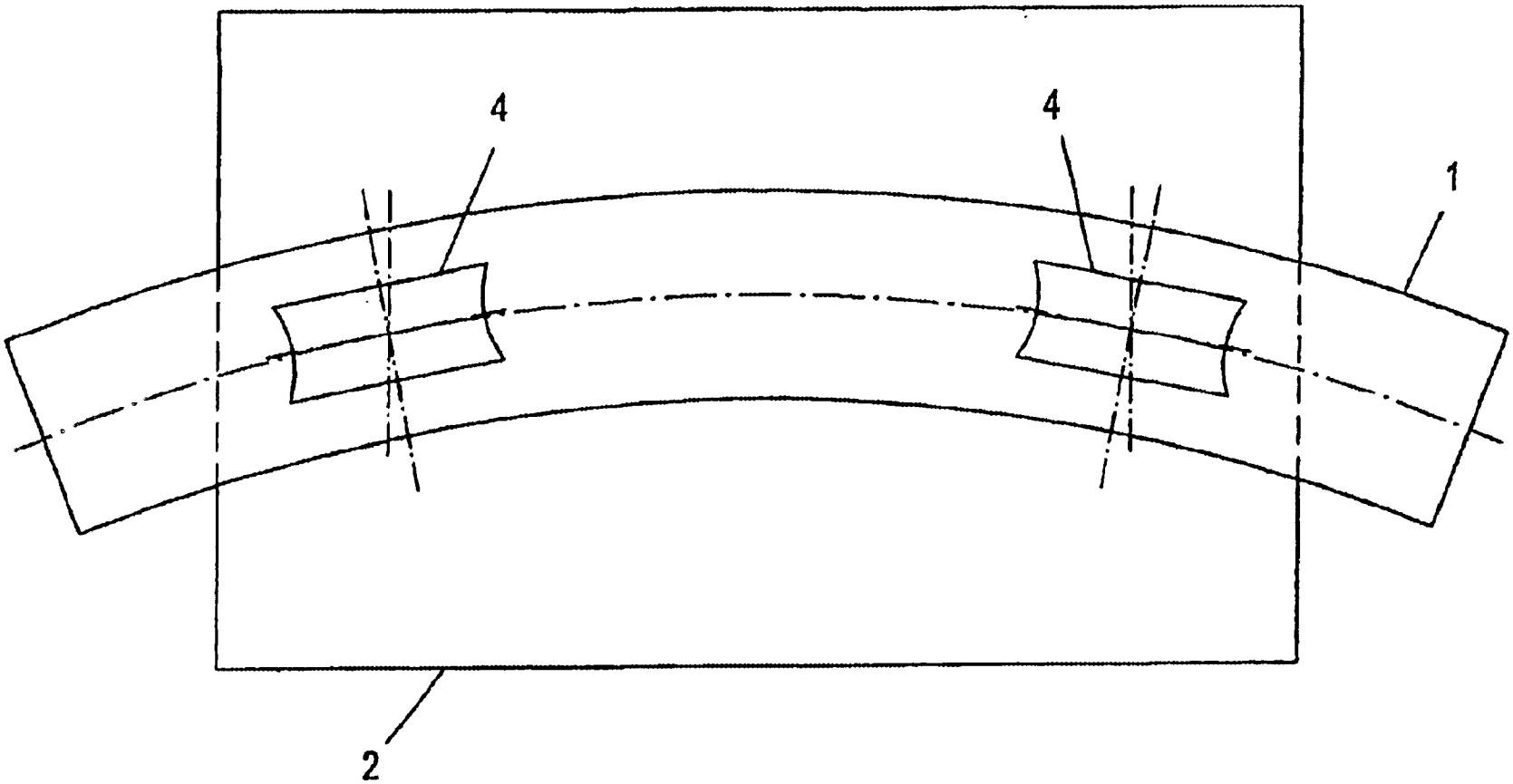
FIG. 11 schematically shows a transport system when traversing a curved section of a rail.
Figure 13:
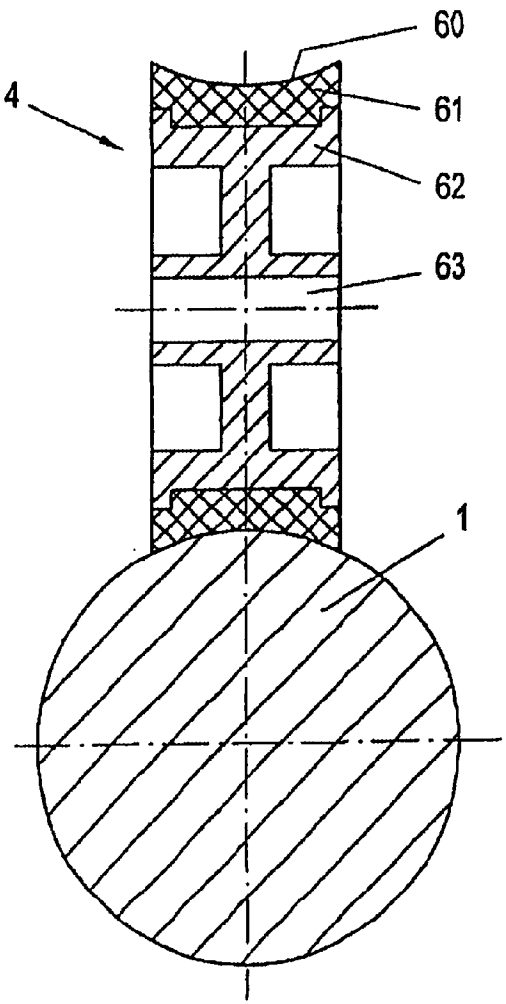
FIG. 13 shows the rollers from FIG. 12 in an axial section.

FIG. 11 shows the track position of the rollers 4 on a (circularly) curved rail 1 according to the above described control behavior.

Figure 7:
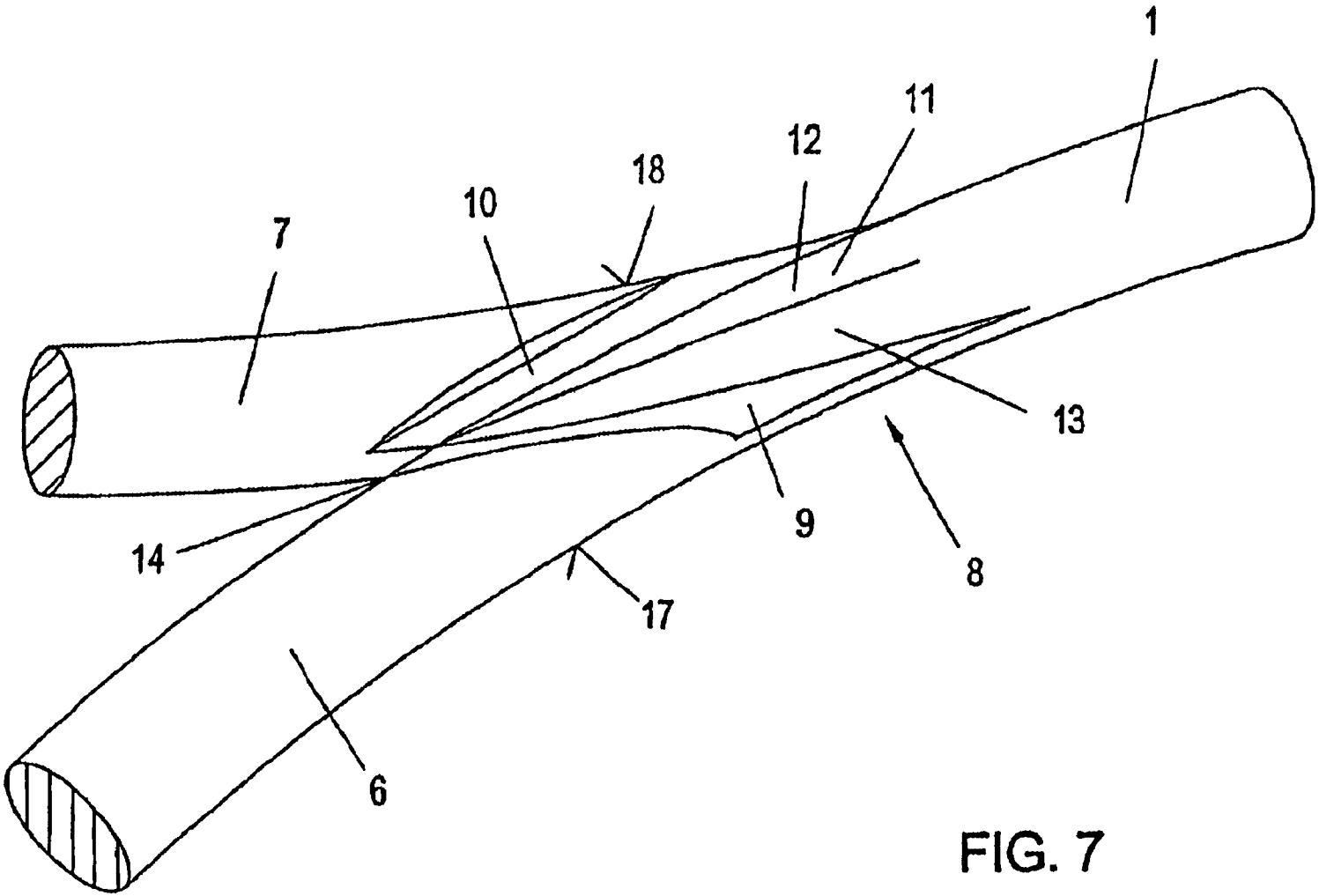
FIG. 7 shows in an oblique view a junction of a rail.
Figure 8:
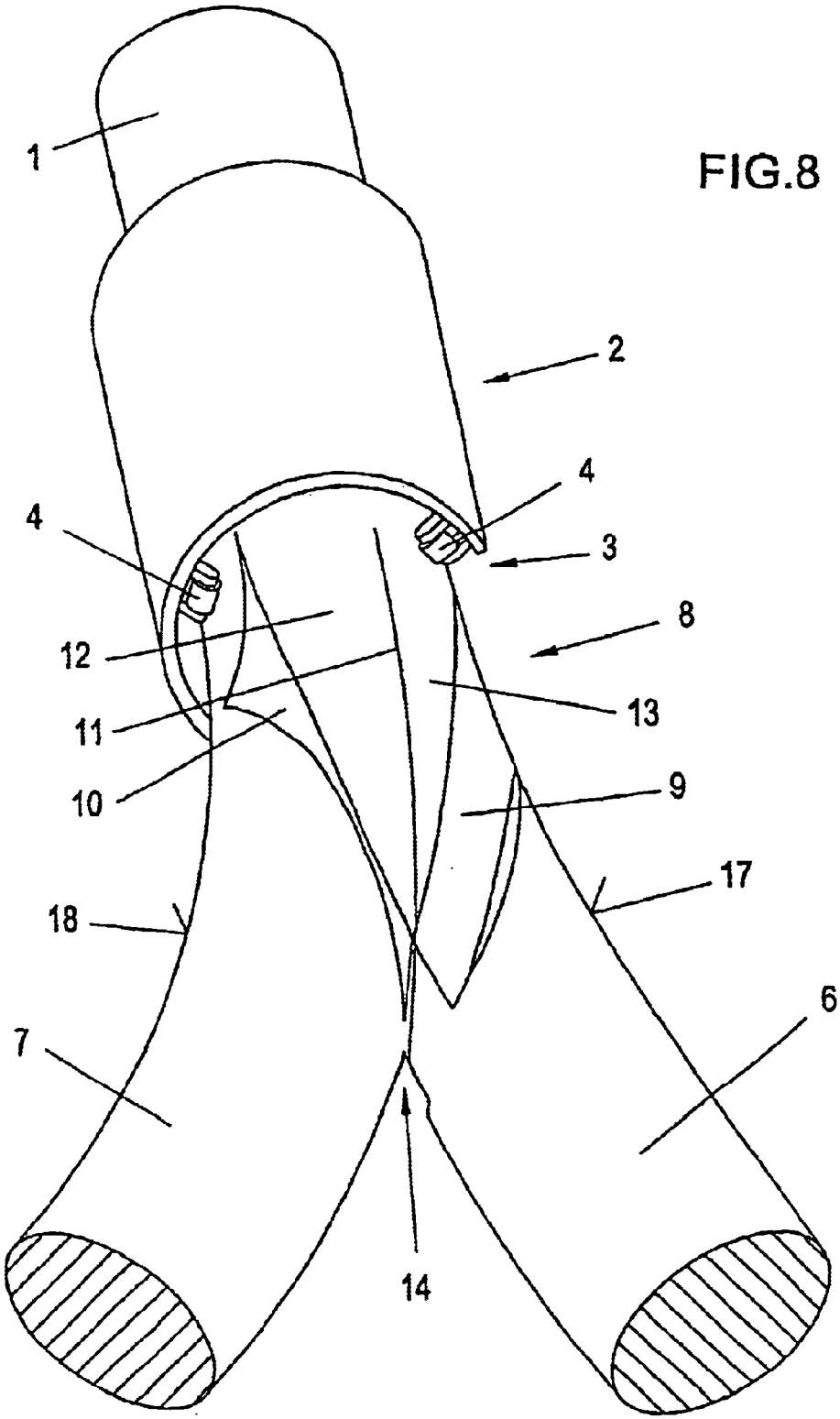
FIG. 8 shows a trolley in the position for driving on the rail branch of the junction which is the left branch in FIG. 8.

FIGS. 7 and 8 shows one embodiment of a junction 8 of a rail 1 as claimed in the invention, in which the two rail branches 6 and 7 are curved. In the embodiment shown in FIGS. 7 and 8 the grooves 9 and 10, differently from in FIG. 3, are not essentially V-shaped, but essentially U-shaped so that more space is formed for the passage of the rollers 4 of the trolley 2. It is apparent that here there are also tapering ribs 11 on the top and on the bottom of the junction 8, with surfaces 12 and 13 which form parts of the outside surfaces of the rail branches 6 and 7.

In the embodiment of a junction as shown in FIGS. 7 and 8 the run of the grooves 9 and 10, regardless of whether they are V-shaped grooves (as in FIG. 3) or U-shaped grooves (as is FIGS. 7 and 8) is chosen such that they each run parallel to the axes of the rail branches 6 and 7. Conversely to the embodiment shown in FIG. 3 in which there is a straight groove 10 which runs according to the axis 15 of the rail branch 6, and there is a curved groove 9 which follows the axis 16 of the branching, curved rail branch 7, in the embodiments shown in FIGS. 7 and 8 according to the two curved rail branches 6 and 7 the two grooves 9 and 10 are curved on the top and bottom of the junction 8.

FIG. 8 shows the position of the trolley 2 with its rollers 4, when the rail branch 7 which branches to the left in FIG. 8 is to be traversed. It is apparent that the middle roller 4 rests against the side 18 of the rail branch 7 which faces away from the other rail branch 6 (which is not to be traversed) and is guided on this continuing surface 18 such that the other two rollers 4 which are provided in the area of the edges 5 of the slot 3 in the trolley 2 first roll on the surfaces 13 of the tapering ribs 11 and finally reach the rail branch 7 which branches to the left.

After a junction 8 has been traversed, the trolley 2 can be turned back again into the rotary position as shown in FIG. 4*a* or 4*b*.

Figure 5:
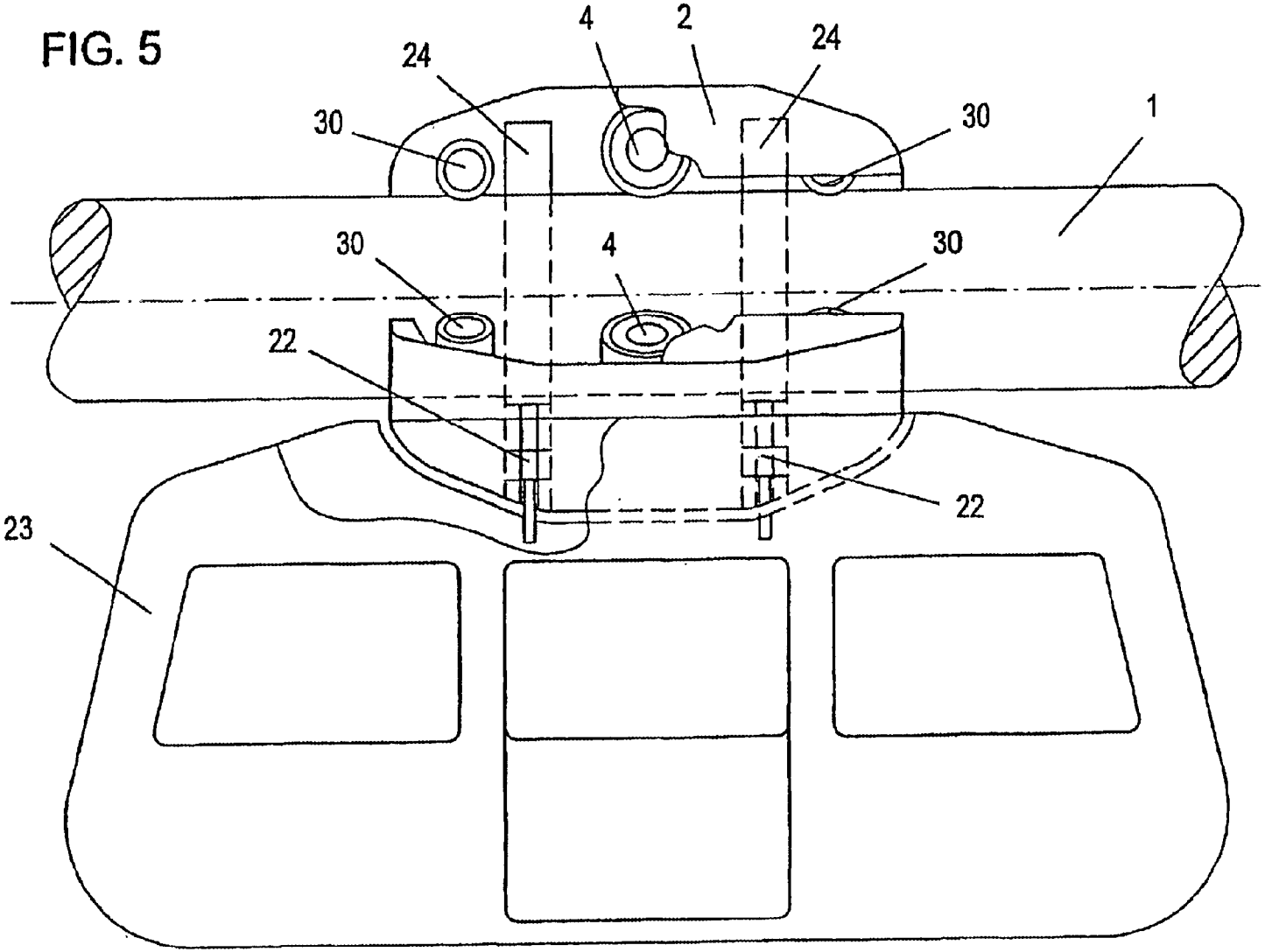
FIG. 5 shows one embodiment for the car.

FIG. 5 shows by way of example one practical embodiment of a transportation system as claimed in the invention with a car 23 on one rail and the pivotally supported trolley 2. The trolley 2 in this embodiment has three rollers 4, of which two are driven for example by the drive 55 (FIG. 9). In front of and behind the rollers 4, in the trolley 2 three other, freely running and spring-suspended auxiliary rollers 30 are supported. These auxiliary rollers 30 in spite of the grooves 9 and 10 allow quiet crossing of the junctions 8. Furthermore, the auxiliary rollers 30 are advantageous for stabilizing the car 23 in the direction of travel. The trolley 2 is located in FIG. 5 in the position as shown in FIG. 4*b*.

The connection of the car 23 to the trolley 2 is accomplished by two suspensions 22 which are guided in the curved slots 24 of the trolley 2. Thus, active turning of the trolley 2 relative to the car 23 and around the axis of the rail 1 is possible by the drive 40 (FIGS. 4*a–c*) or by inclining the rollers 4 (FIG. 9).

Figure 6:
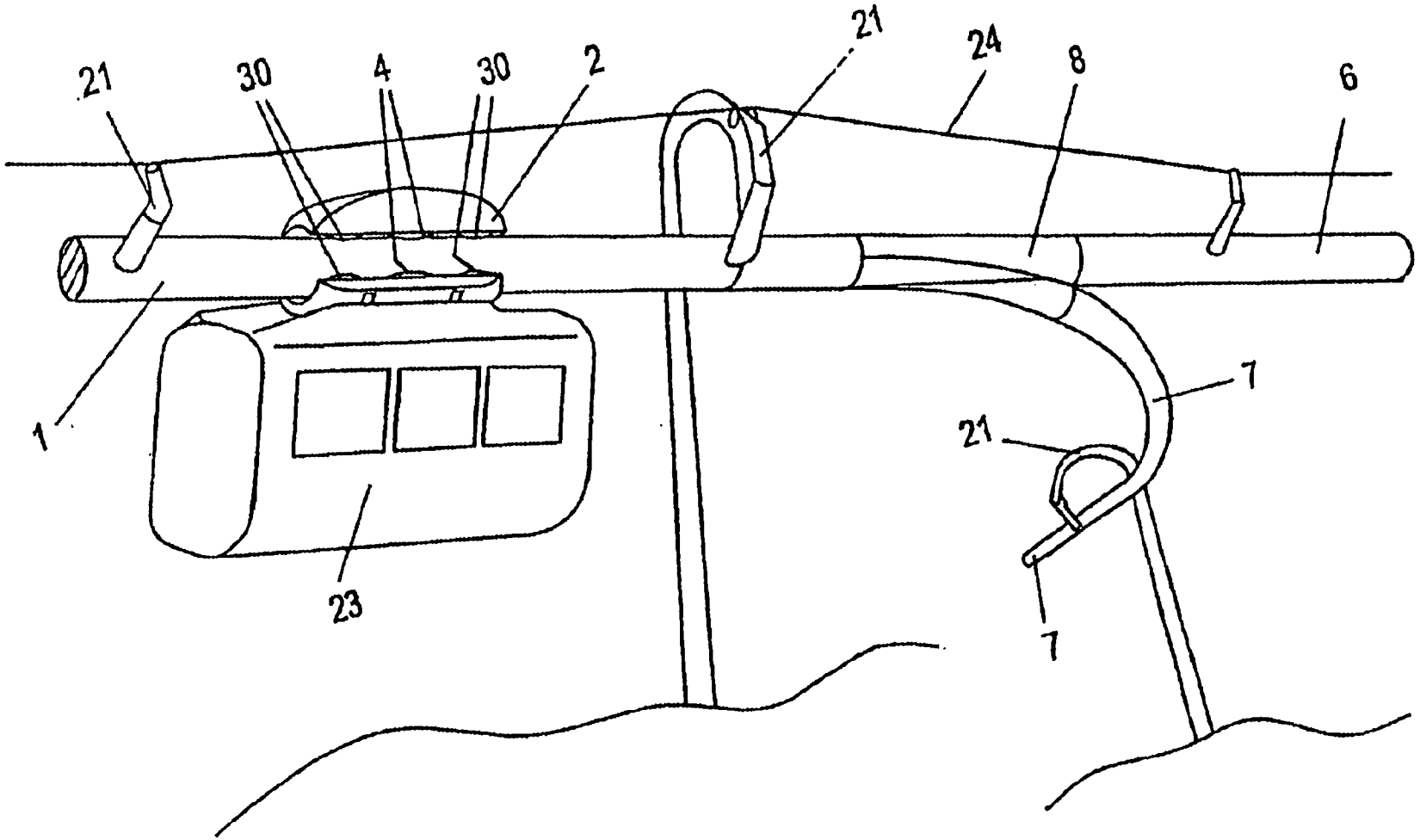
FIG. 6 shows another embodiment.

FIG. 6 shows again, partially schematically and by way of example, one practical embodiment of the transportation system as claimed in the invention with a car 23 which is intended for the transportation of individuals.

The rails 1 of the transportation system can be mounted suspended preferably on supports 21 or on cables 24.

The transportation system as claimed in the invention in the embodiments shown in the drawings and described using them has rails 1 in which there can be junctions 8, two rail branches 6 and 7 leading away from the junctions 8. The rail 1 is therefore divided into two rail branches 6 and 7. The cars 23 are suspended on the rail 1 or the rail branches 6, 7 via trolleys 2 with at least three rollers 4 which are pivotally supported in the trolleys 2. The cars 23 can be moved for example along the rail 1 and the rail branches 6 or 7 by driving at least one of the rollers 4.

A junction 8, in the area of which the rail 1 is divided into two rail branches 6 and 7, has on its top and on its bottom two, for example essentially V-shaped or U-shaped grooves 9, 10, each of which can be made symmetrical or asymmetrical (for example, of different depth to the top and bottom), so that at least one trolley 2 which is provided on the car 23, depending on its rotary position, travels onto one rail branch 6 or 7 or the other. In this respect the (at least one) trolley 2 is connected to the car 23 such that it can be turned around the axis of the rail 1 when travelling.

The trolley 2 as described encompasses the rail 1 via the rollers 4 which are supported in it to such an extent that reliable suspension of the car 23 on the rail 1 is ensured. The slot 3 in the trolley 2 on the one hand allows crossing of the junctions 8 and on the other passage by suspensions 21 or 25 of the rail 1 or on auxiliary rails for power supply.

The transportation system as claimed in the invention is especially well suited for fully automated operation with widely branched, complex rail networks. Versions of the transportation system can be equipped for this purpose with all necessary components, such as position sensors, telemetry and computer systems, for fully automatic monitoring and control (also of the turning of the trolley). The cars can be equipped with an electric drive, supply of the drive with current being possible by batteries or by additional contact rails. When the transportation system as claimed in the invention has two rails 1 which run parallel, they can also be used for supply of the drive of the car with electric power.

It is especially important and especially advantageous in the transportation system as claimed in the invention that the junctions 8 are made without moving parts so that, differently than in switches with movable parts, no maintenance activities or problems by fouling or environmental influences (for example, rain, snow, ice) need be feared.

The principle of the transportation system as claimed in the invention can also be used for the current collector. The rail is current-carrying in this case and the trolley 2 is the current collector which is connected to the car 23.

In the transportation system as claimed in the invention preferably rollers 4 of plastic with curved contact surfaces are used, and the bearing surface of the rollers 4 can extend over a certain radial area of the rails 1. These rollers 4 are described by way of example using FIGS. 12 to 16.

Plastic (for example polyamide or polyurethane elastomer) rollers 4 are advantageous as a result of their advantageous properties, such as quiet running, high load-bearing capacity, and economical production.

Figure 12:
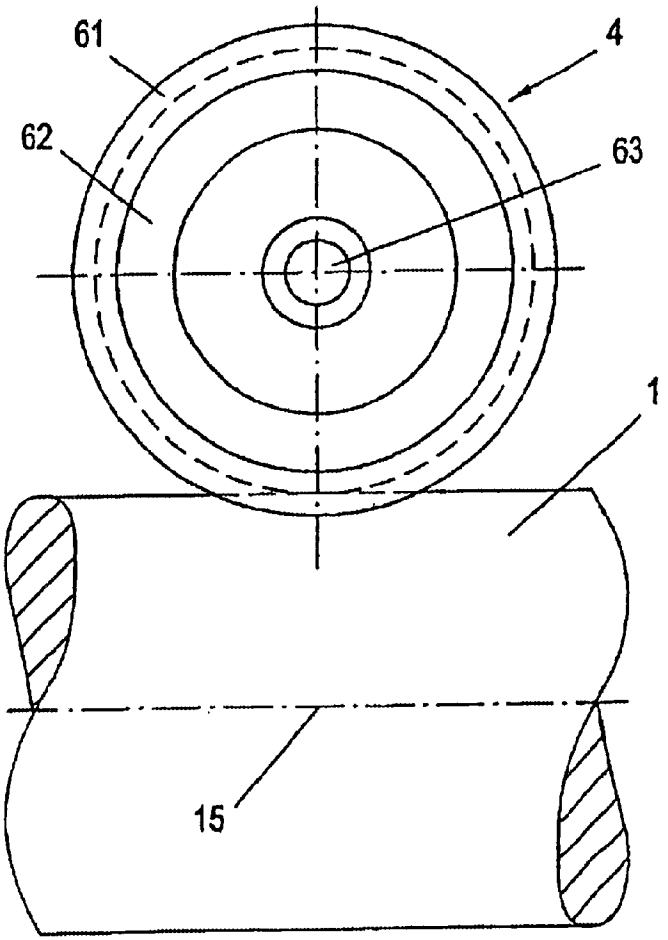
FIG. 12 in a side view shows a roller which is preferred for the transportation system as claimed in the invention.

FIG. 12 shows a roller 4' with a concave curved contact surface 60 curved in the shape of an arc. The roller 4 consists of a race 61 which is made of elastic plastic and which is identified in FIGS. 12 to 16 by cross-hatching, and a running body 62 which is provided with a central axial hole 63 and which can be made of plastic or metal. The running body and the ball race are connected to one another by force-fit, as can be achieved for example by spraying the ball race onto the running body 62. The roller 4 moves on a rail 1 with a circular cross section so that the roller 4 is in contact with the rail 1 via a running surface 60 which is curved in an arc shape. The size and shape of the contact surface between the running surface 60 and the rail 1 depend on the elasticity and the compressive loading of the ball race 61.

If a roller 4 has a curved running surface 60, as is the case for example in rails 1 with a circular cross sectional shape, the effect arises that the contact points with different radial distances have different peripheral speeds and thus different paths. For elastic ball races 61, this can lead to friction losses which under unfavorable conditions lead to heating of the rollers 4, to reduced adhesion and optionally even to damage of the roller 4.

The level of the friction losses depends on the geometrical conditions (curvature of the rail cross section, diameter of the roller), and on the loading conditions and the elasticity of the material of the roller 4 on the running surface 60. In general, a high contact pressure, as is needed especially for driven or braked rollers 4 for transfer of the acceleration and deceleration forces, will lead to an increase of the contact surface and thus to greater friction losses as a result of different peripheral speeds. Rollers 4 of conventional design can therefore be suited only conditionally for certain applications.

The rollers 4 which can be used preferably within the framework of the invention, with curved running surfaces 60, are made such that on the one hand friction losses are minimized, on the other hand the adhesion is increased for transfer of forces (for example, driving or braking forces).

Figure 15:
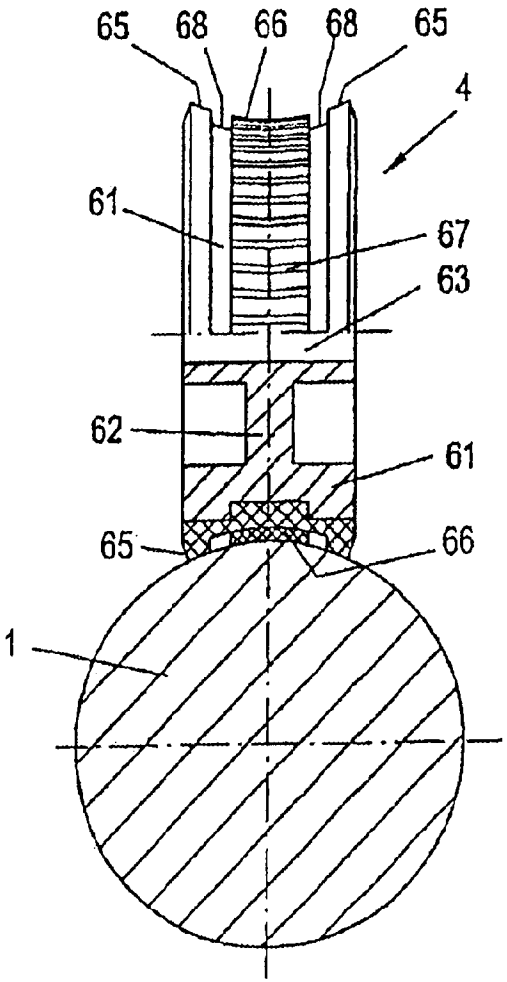
FIG. 15 shows the roller from FIG. 14 in another view and partially cutaway.
Figure 14:
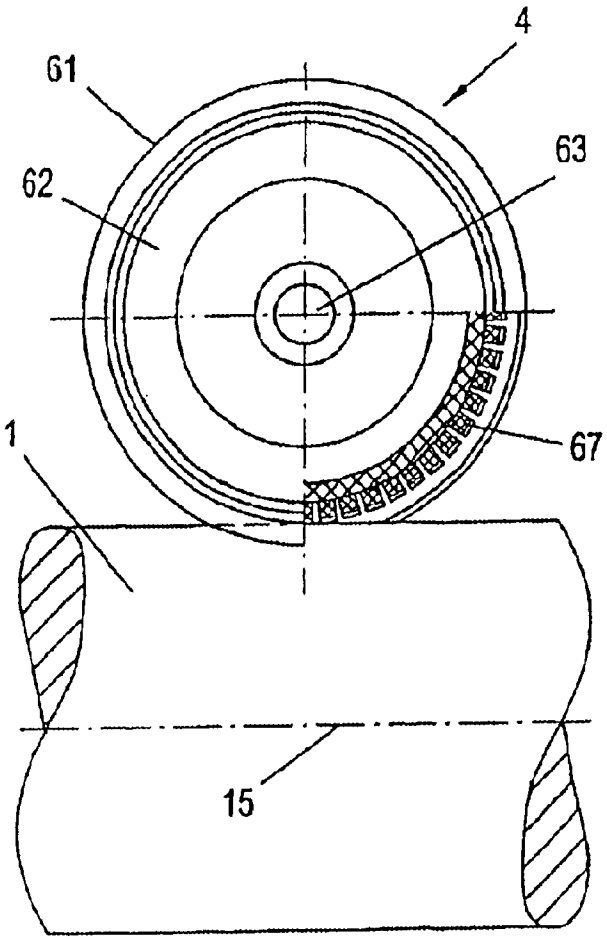
FIG. 14 shows another embodiment of a roller for a transportation system, partially cutaway.
Figure 16:
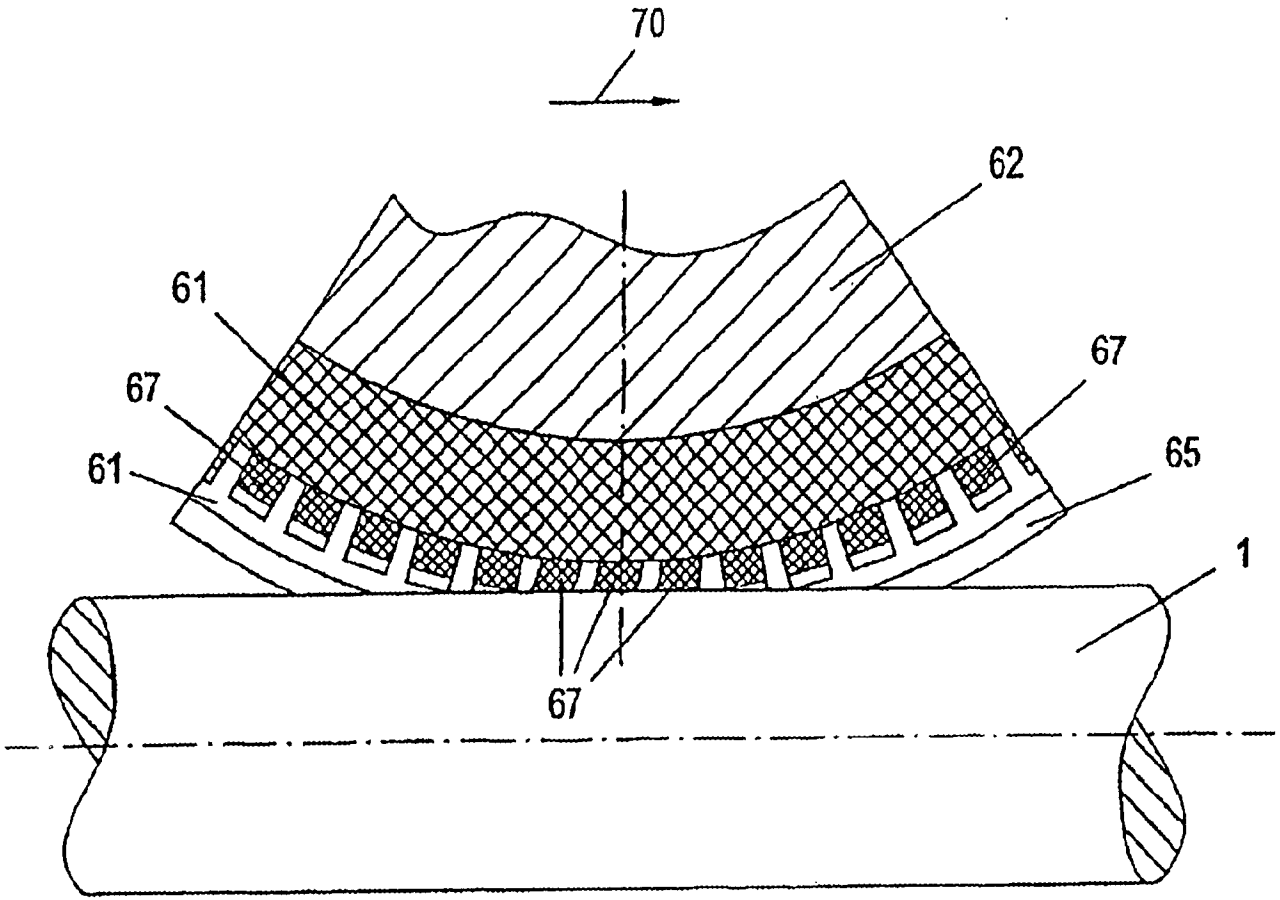
FIG. 16 shows an enlarged detail of the roller from FIG. 14 and FIG. 15.
Figure 17:
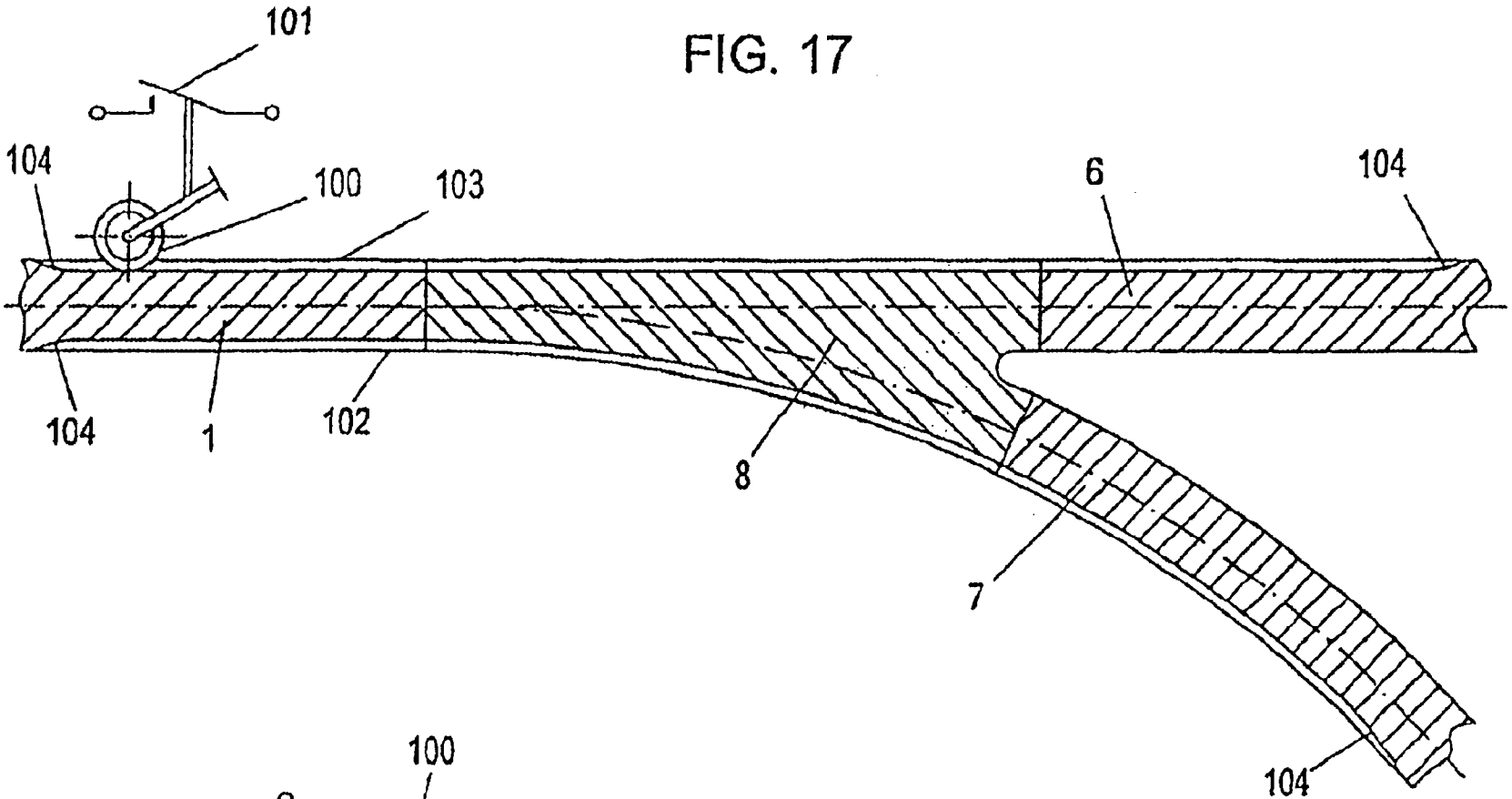
FIG. 17 shows a horizontal lengthwise section of a junction of one modified embodiment and FIG. 18 shows a section along line XVIII—XVIII in FIG. 17.
Figure 18:
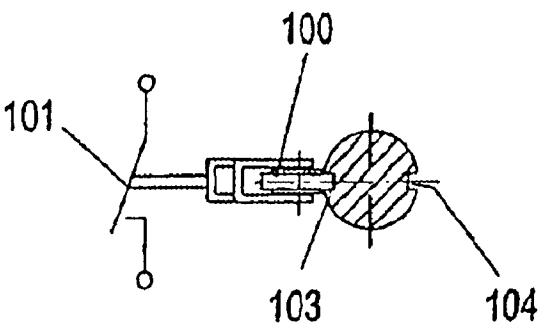

FIGS. 14 to 16 show one preferred embodiment of a roller 4. Here the running surface 60 of the ball race 61 is divided into sections 65 and 66, the sections 65 being located on the two outside areas and the section 66 being located in the middle area of the running surface 60. The outer sections 65 are separated by recesses 68 (annular grooves) from the middle section 66. The sections 65 based on the larger diameter of the running surface 60 in the outside area have a higher radial peripheral speed than the section 66. When the roller 4 rolls on the rail 1, therefore elastic deformation in the area of the running surface 60 of the ball race 61 occurs. To accommodate this deformation the middle section 66 is formed from the ribs 67 which are transverse to the running direction and which are located along the periphery.

FIG. 16 shows a detailed extract of the roller 4 from FIGS. 14 and 15, the rolling process being shown when travelling in the direction of the arrow 70. A contact pressure has been assumed which leads to a contact surface which extends over three ribs 67. Furthermore, it was assumed that the relative speed of the roller 4 to the rail 1 is determined by the unprofiled sections 65 of the ball race 61 which have a higher peripheral speed than that of the middle section 66.

The ribs 67 which are located in the contact area bend as a result of the lower peripheral speed against the direction of travel (arrow 70) to the rear. This deformation leads to an increase of the contact pressure on the front edges of the ribs, by which the adhesion of the ribs 67 on the rail 1, especially when the roller 4 is driven, is increased. It is apparent from FIG. 16 that the profiling leads to a reduction of the energy necessary for deformation of the ball race 61 in the surface area, compared to an unprofiled ball race 61. In this way the friction losses can be dramatically reduced, but the adhesion of the roller 4 on the rail 1 can be increased.

The ball race 61 can be in one piece or several pieces, made of plastics with different properties (hardness, adhesive friction on the rail 1). For example, the outer sections 65 of the ball race 61 can consist of harder plastic and the middle section 66 can consist of softer plastic.

The assumption is that after the junction 8 the left or right rail branch 6 or 7 can be traversed reliably and without collisions and that the trolley 2 has been turned with certainty and completely into the correct position.

For transportation systems which are intended solely for freight transportation, one electronic location control system and electronic safety means are sufficient. For transportation systems which are used for transport of people, in the area of the branches there can be monitoring and safeguarding of the correct rotation position.

In order to ensure that after turning of the trolley 2 before the junction 8 and also when the control or the actuators fail, the set position of the trolley 2 is preserved, in one embodiment there are grooves 102, 103 in the neutral zones of the rail 1 and the rail branches 6, 7 (they are those areas on which the middle roller 4 rolls as soon as the trolley 2 has been turned into the set position (for example FIG. 4*c* and FIG. 8)). A catch means 100 which can be made either as a slider or as a roller and which is located on the trolley 2 fits into one groove 102, 103 or the other depending on the rotary position of the trolley 2.

When the catch means 100 fits into the groove 102 or 103 (depending on the rotary position of the trolley 2) an acknowledgement is sent, via a switching element 102 which is assigned to the catch means 100, to the control, that the set position for traversing the left rail branch 6 or the right rail branch 7 has been successfully assumed and that the catch means 100 fits into the groove 102 or 103 and for example has been locked in this position. If this is the case, the trolley 2 is released for further traversal of the junction 8. This ensures that after this process a problem is not able to prevent the trolley 2 from safely traversing the junction 8.

After leaving the junction 8, the catch means 100 is unlocked by the grooves 102, 103 running out on their ends 104 and the trolley 2 can be turned again so that turning the trolley back 2 into its normal rotary position (FIG. 4*a*) can be initiated via the control.

If the acknowledgement about the engagement of the catch means 100 does not take place at a corresponding location of the rail in front of a junction 8, emergency braking is initiated and stops the trolley 2 with the cabin 23 before reaching the junction 8 and the possible collision.

Therefore it happens that the grooves 102, 103 should have a length which corresponds to the length of the junction 8 itself, increased by twice the braking path with maximum speed, maximum load and minimum adhesive friction of the rollers 4 (with a wet track body).

The correct rotary position of the trolley 2 can be checked relative to the rail 1 especially before traversing a junction 8 even without contact. In this embodiment, on the rail 1 there is striping, for example in the form of optically, capacitively or magnetically detectable strips, and in the trolley 2 there is a sensor which detects the strip and which delivers a corresponding signal to the control when the trolley 2 has been turned into the desired rotary position.

In summary, one example of the invention can be described as follows:

A transportation system has at least one rail 1, preferably suspended on supports or hanging on cables, on which cars 23 can be moved via at least one trolley 2. In the trolleys 2 of the car 23 there are several rollers 4 and the trolley 2 can be actively turned around the axis of the rail relative to the car 23.

In the rail 1 there are junctions 8 in which the rail 1 is divided into two rail branches 6 and 7. In the area of the junction 8 there is the intersection of the outside surfaces of the rail branches 6 and 7 so that in the area of the junction 8 on the top and on the bottom due to the intersection there are two grooves 9, 10 at a time which meet in the area of the gusset 14 between the rail branches 6, 7. Between the grooves 9, 10 on the top and the bottom there is one tapering rib 11 each, the surfaces 12, 13 of which are parts of the jacket surface of the rail branches 6, 7 in the area of the junction 8.

By actively turning the trolley 2 relative to the car 23 it can be determined on which of the two rail branches 6 and 7 the car 23 which travels from the rail 1 to the junction 8 moves.

In the trolleys 2, rollers 4 with a ball race 61 produced from elastic plastic with a curved running surface 60 which is matched to the rail 1 in cross section can be used. The ball race 61 is divided into radial sections 65, 66, the middle section 66 being profiled rib-like. In this way friction losses which occur as a result of the different peripheral speeds in the contact area of the running surface 60 are reduced and the adhesion of the roller 4 on the rail 1 can be increased.

What is claimed is:

1. Transportation system comprising:

at least one rail (1); and at least one car (23) which can travel via at least one trolley (2) along the rail (1), the trolley (2) only partially encompassing the rail (1), the trolley having a slot (3), the trolley being guided on the rail (1) and turnable relative to the car (23) around the axis of the rail (1), and the rail (1) having at least one junction (8) dividing the rail (1) into two rail branches (6, 7), characterized in that the rail (1) and the rail branches (6, 7) have a circular cross sectional shape, that in an area of the junction (8) both on the top and on the bottom of the rail (1) and in the rail branches (6, 7) there are grooves (9, 10) which between themselves border one tapering rib (11) on each of the top and the bottom of the junction (8), which rib ends in an area of a gusset (14) between the rail branches (6, 7), and that the trolley (2) can be actively turned.

2. Transportation system as claimed in claim 1, wherein the grooves (9, 10) run in a direction of the axes (15, 16) of the rail branches (6, 7).

3. Transportation system as claimed in claim 1, wherein the grooves (9, 10) have an essentially U-shaped or V-shaped cross section.

4. Transportation system as claimed in claim 1, wherein the trolley (2) is guided on the rail (1) or the rail branches (6, 7) via at least three rollers (4).

5. Transportation system as claimed in claim 4, wherein the rollers (4) of the trolley (2) include with one another an angle of roughly 120°.

6. Transportation system as claimed in claim 5, wherein in the area of the junction (8) the middle roller (4) of the three rollers (4) of the trolley (2) adjoins the surface (17, 18) of the junction (8) which is opposite the rail branch (7, 6) which is not to be traversed.

7. Transportation system as claimed in claim 1, wherein the surfaces (12, 13) of the ribs (11) are shaped according to the contour of the rail branches (6, 7) and wherein these surfaces (12, 13) in the area of the junction (8) form parts of the outside surfaces of the rail branches (6, 7).

8. Transportation system as claimed in claim 5, wherein at least one roller (4) of the trolley (2) is rotary-driven.

9. Transportation system as claimed in claim 4, wherein to turn the trolley (2) there is a drive (40) with which the trolley (2) can be turned such that the rollers (4) which are located next to the slot (3) in the trolley (2) when crossing a junction (8) fit into the grooves (9, 10) which are opposite one another.

10. Transportation system as claimed in claim 9, wherein the trolley (2) can be turned by an actuator (40) via a transmission (41, 42).

11. Transportation system as claimed in claim 4, wherein the rollers (4) which guide the trolley (2) on the rail (1) can be moved via an actuator (50) such that the rollers (4) are inclined at an angle (I) to the rail (1) and the trolley (2) turns along the rail (1) in its motion.

12. Transportation system as claimed in claim 9, wherein there is an electronic control which controls the drive (40) for turning the trolley (2) by means of sensors (M, N) such that the trolley (2) is turned relative to the car (23) into the set position (H) for traversing one of the rail branches (6, 7) after a junction (8).

13. Transportation system as claimed in claim 9, wherein there is an electronic control (O) which controls the actuator (50) by means of sensors (M, N) such that the rollers (4) are inclined relative to the rail axis (15) by a setting angle (I) such that the trolley (2) is turned into the desired set position (H) when travelling along the rail (1).

14. Transportation system as claimed in claim 4, wherein there is an electronic control (O) which controls the actuator (50) by means of sensors (M, N) such that the rollers (4) are swivelled such that the track of the rollers (4) follows the curved path (W) of the rail (1).

15. Transportation system as claimed claim 1, wherein in the area of a junction (8) and the rail branches (6, 7) proceeding from the junction (8) in the rail (1) and in the rail branches (6, 7) there are grooves (103, 104) and wherein in the trolley (2) there is at least one catch means (100).

16. Transportation system as claimed in claim 15, wherein a switching element (101) is assigned to the catch means (100).

17. Transportation system as claimed in claim 16, wherein the switching element (101) is linked to the electronic control (O) and detects the catch means (100) fitting or not fitting into one of the grooves (102, 103).

18. Transportation system as claimed in claim 1, wherein the rails (1) and the rail branches (6, 7) bear striping which can be detected without contact by at least one sensor which is located in the trolley (2) when the trolley (2) assumes the rotary position which is desired at the time.

19. Transportation system with at least one rail (1) and with at least one car (23) which can travel via at least one trolley (2) along the rail and which is guided via rollers (4) on the rail (1), as claimed in claim 1, wherein the running surfaces (60) of the rollers (4) are concavely curved congruently to the outside contour of the rail (1).

20. Transportation system as claimed in claim 19, wherein the rollers (4) have races (61) which are made of elastic plastic.

21. Transportation system as claimed in claim 20, wherein the running surface (60) of the races (61) is divided into at least two sections (65, 66), of which at least a middle section (66) has profiling (67) which is made transversely to a running direction (arrow 70).

22. Transportation system as claimed in claim 21, wherein the middle section (66) has ribs (67) which are transverse to the roller (4).

23. Transportation system as claimed in claim 21, wherein the sections (65, 66) of the race (61) consist of different plastics.

24. Transportation system as claimed in claim 21, wherein the middle section (66) consists of a softer material than two outer sections (65) of the race (61).

* * * * *